US007530901B2

(12) United States Patent
Imamoto et al.

(10) Patent No.: US 7,530,901 B2
(45) Date of Patent: May 12, 2009

(54) GOLF CLUB HEAD

(75) Inventors: Yasunori Imamoto, Tokyo (JP); Hisashi Yamagishi, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 456 days.

(21) Appl. No.: 11/252,801

(22) Filed: Oct. 19, 2005

(65) Prior Publication Data

US 2006/0084525 A1 Apr. 20, 2006

(30) Foreign Application Priority Data

Oct. 20, 2004 (JP) ..... P2004-305910

(51) Int. Cl.
*A63B 53/04* (2006.01)

(52) U.S. Cl. ..... 473/334; 473/345; 473/347; 473/349

(58) Field of Classification Search ..... 473/324–350, 473/287–292

See application file for complete search history.

(56) References Cited

U.S. PATENT DOCUMENTS

| | | | |
|---|---|---|---|
| 3,652,094 | A | 3/1972 | Glover |
| 4,021,047 | A | 5/1977 | Mader |
| 4,432,549 | A | 2/1984 | Zebelean |
| 4,438,931 | A | 3/1984 | Motomiya |
| 5,205,560 | A | 4/1993 | Hoshi et al. |
| 5,255,913 | A | 10/1993 | Tsuchida |
| 5,547,427 | A | 8/1996 | Rigal et al. |
| 5,570,886 | A | 11/1996 | Rigal et al. |
| 5,624,331 | A | 4/1997 | Lo et al. |
| 5,669,827 | A | 9/1997 | Nagamoto |
| 5,766,095 | A | 6/1998 | Antonious |
| 5,967,904 | A | 10/1999 | Nagai et al. |
| 5,997,415 | A | 12/1999 | Wood |
| 6,010,411 | A | 1/2000 | Reyes |
| 6,089,992 | A | 7/2000 | Onuki et al. |
| 6,162,130 | A | 12/2000 | Masumoto et al. |
| 6,248,025 | B1 | 6/2001 | Murphy et al. |
| 6,254,494 | B1 | 7/2001 | Hasebe et al. |
| 6,332,847 | B2 | 12/2001 | Murphy et al. |
| 6,340,337 | B2 | 1/2002 | Hasebe et al. |

(Continued)

FOREIGN PATENT DOCUMENTS

| | | | |
|---|---|---|---|
| JP | 4-89071 | A | 3/1992 |

(Continued)

OTHER PUBLICATIONS

Japanese Abstract No. 2004180759, dated Jul. 2, 2004.

(Continued)

*Primary Examiner*—Sebastiano Passaniti
(74) *Attorney, Agent, or Firm*—Sughrue Mion, PLLC

(57) ABSTRACT

A hollow golf club head includes a fiber-reinforced-plastic body and a metal body. The fiber-reinforced-plastic body includes a main portion of a crown portion. The metal body includes a face portion, a front edge portion of the crown portion continuous with the face portion, and a central portion of a sole portion in a toe-heel direction. The front edge portion of the crown portion made of a metal defines a recess portion in an upper surface thereof. A front edge portion of the fiber-reinforce-resin body overlaps and is joined to the front edge portion of the crown portion made of the metal.

8 Claims, 8 Drawing Sheets

U.S. PATENT DOCUMENTS

| | | | | |
|---|---|---|---|---|
| 6,354,962 | B1 | 3/2002 | Galloway et al. | |
| 6,354,963 | B1 | 3/2002 | Kodama et al. | |
| 6,371,868 | B1 | 4/2002 | Galloway et al. | |
| 6,381,828 | B1 | 5/2002 | Boyce et al. | |
| 6,406,378 | B1 | 6/2002 | Murphy et al. | |
| 6,435,977 | B1 | 8/2002 | Helmstetter et al. | |
| 6,435,978 | B1 | 8/2002 | Galloway et al. | |
| 6,440,008 | B2 | 8/2002 | Murphy et al. | |
| 6,440,011 | B1 | 8/2002 | Hocknell et al. | |
| 6,471,604 | B2 | 10/2002 | Hocknell et al. | |
| 6,491,592 | B2 | 12/2002 | Cackett et al. | |
| 6,524,194 | B2 | 2/2003 | McCabe | |
| 6,524,198 | B2 | 2/2003 | Takeada | |
| 6,527,650 | B2 | 3/2003 | Reyes et al. | |
| 6,575,845 | B2 | 6/2003 | Galloway et al. | |
| 6,582,321 | B2 | 6/2003 | Galloway et al. | |
| 6,582,323 | B2 | 6/2003 | Soracco et al. | |
| 6,602,149 | B1 | 8/2003 | Jacobson | |
| 6,607,452 | B2 | 8/2003 | Helmstetter et al. | |
| 6,620,056 | B2 | 9/2003 | Galloway et al. | |
| 6,623,378 | B2 | 9/2003 | Beach et al. | |
| 6,648,774 | B1 | 11/2003 | Lee | |
| 6,663,504 | B2 * | 12/2003 | Hocknell et al. | 473/329 |
| 6,676,536 | B1 | 1/2004 | Jacobson | |
| 6,739,982 | B2 | 5/2004 | Murphy et al. | |
| 6,739,984 | B1 | 5/2004 | Ciasullo | |
| 6,872,152 | B2 | 3/2005 | Beach et al. | |
| 6,945,876 | B2 | 9/2005 | Nakahara et al. | |
| 7,128,662 | B2 * | 10/2006 | Kumamoto | 473/345 |
| 7,297,074 | B2 * | 11/2007 | Kumamoto | 473/345 |
| 2001/0049310 | A1 | 12/2001 | Cheng et al. | |
| 2002/0160858 | A1 | 10/2002 | Lee | |
| 2003/0083151 | A1 | 5/2003 | Nakahara et al. | |
| 2003/0125127 | A1 | 7/2003 | Nakahara et al. | |
| 2003/0134692 | A1 | 7/2003 | Nakahara et al. | |
| 2003/0134693 | A1 | 7/2003 | Nakahara et al. | |
| 2004/0005936 | A1 | 1/2004 | Imamoto et al. | |
| 2004/0116208 | A1 | 6/2004 | De Shiell et al. | |
| 2004/0266551 | A1 | 12/2004 | Noguchi et al. | |
| 2006/0063608 | A1 | 3/2006 | Mori et al. | |

FOREIGN PATENT DOCUMENTS

| | | | |
|---|---|---|---|
| JP | 05-068725 | | 3/1993 |
| JP | 06-039941 | | 2/1994 |
| JP | 7-406 | U | 1/1995 |
| JP | 7-112041 | | 5/1995 |
| JP | 7-112042 | | 5/1995 |
| JP | 07-155410 | | 6/1995 |
| JP | 08-024377 | | 1/1996 |
| JP | 09-038250 | | 2/1997 |
| JP | 09-187534 | | 7/1997 |
| JP | 09-215786 | | 8/1997 |
| JP | 09-322953 | | 12/1997 |
| JP | 10-015119 | | 1/1998 |
| JP | 11-319167 | A | 11/1999 |
| JP | 2000-024149 | A | 1/2000 |
| JP | 2000-033133 | | 2/2000 |
| JP | 2000-167090 | A | 6/2000 |
| JP | 2003-320060 | | 11/2000 |
| JP | 2001-062003 | A | 3/2001 |
| JP | 2001-087426 | A | 4/2001 |
| JP | 2001-149514 | A | 6/2001 |
| JP | 2001-309998 | A | 11/2001 |
| JP | 2001-321474 | A | 11/2001 |
| JP | 2001-340499 | | 12/2001 |
| JP | 2002-000773 | A | 1/2002 |
| JP | 2002-011122 | | 1/2002 |
| JP | 2002-224249 | | 8/2002 |
| JP | 2003-062130 | | 3/2003 |
| JP | 2003-144590 | | 5/2003 |
| JP | 2003-205055 | | 7/2003 |
| JP | 2004-016654 | | 1/2004 |
| JP | 2004-065810 | | 3/2004 |
| WO | WO 2004/052472 | A1 | 6/2004 |

OTHER PUBLICATIONS

Japanese Abstract No. 2003320060, dated Nov. 11, 2003.

Japanese Office Action dated Nov. 2, 2006 issued in JP Patent Application No. 2002-178798.

Japanese Office Action dated Jan. 22, 2007 issued in JP Patent Application No. 2002-178798.

Japanese Office Action dated May 8, 2007 issued in JP Patent Application No. 2002-178798.

* cited by examiner

GOLF CLUB HEAD

BACKGROUND OF THE INVENTION

1. Field of the Invention

The present invention relates to a hollow golf club head, and more particularly to a golf club head of a wood type or having a shape similar thereto.

2. Description of the Related Art

As wood-type golf club heads such as drivers and fairway woods, hollow metallic heads are widely in use. Generally, the hollow wood-type golf club head has a face portion for hitting a ball, a crown portion constituting an upper surface portion of the golf club head, a sole portion constituting a bottom surface portion of the golf club head, a side portion constituting side surface portions on the toe side, the rear side, and the heel side of the golf club head, and a hosel portion. A shaft is inserted in this hosel portion, and is fixed by an adhesive agent or the like. It should be noted that golf clubs called utility clubs are also commercially available in large numbers, and various golf clubs having a head similar to the aforementioned wood-type golf club head (i.e., having the face portion, the sole portion, the side portion, the crown portion, and the hosel portion) are also commercially available.

As metals for forming this hollow golf club head, aluminum alloy, stainless steel, and a titanium alloy are used, and the titanium alloy, in particular, has come to be used widely in recent years.

It is possible to enlarge the sweet spot by increasing the volume of the hollow golf club head. To prevent the weight of the golf club head from increasing as a consequence of the increase in the volume, it has been conceived to adopt a fiber plastic resin whose specific gravity is far smaller than the aforementioned metals. In this case, since the face surface for hitting a ball needs to be made of a metal to ensure the strength, portions other than the face portion are made of the fiber plastic resin.

For example, US 2004/0005936 A1 discloses a golf club head adopting the carbon fiber reinforced thermosetting resin (CFRP). Specifically, US 2004/005936 A1 discloses a golf club head is constituted by a metal body and a FRP (fiber reinforced plastic) body (see paragraph 0024). The FRP body is in tight contact with end surfaces of a metal crown portion, a metal side portions (both toe and heel), and a metal sole portion, while the FRP body is in tight contact with the internal surfaces of the edges of these portions so as to overlap the internal surfaces of the edges (see paragraph 0032). To form the FRP body and integrate the FRP body with the metal body, the metal body whose internal surface has been subjected to primer treatment in accordance with necessity is disposed in a mold shaped correspondingly to the outer shape of the golf club head. Next, a prepreg sheet laminate (uncured resin-fiber composite material sheet) is disposed along the internal surface of the mold and the internal surface of the edge of the metal body. After that, the resin is heated and cured while gas pressure is applied to the inside through an opening of an annular portion (see paragraph 0033).

SUMMARY OF THE INVENTION

In the case where the prepreg sheet is superposed on and joined to the inner surface (lower surface) of the metal crown portion, it is preferable that the prepreg sheet is temporarily fixed to the metal crown portion to be kept immovable. For the purpose of this temporary fixing, it is preferable to interpose an adhesive resin between the prepreg sheet and the metal crown portion; however, when heating and pressurization are performed, there is a possibility that the viscosity of this adhesive resin declines and the adhesive resin flows out.

In order to solve this problem, the invention provides a golf club head, which makes it possible to easily join and integrate the metal crown portion and the fiber reinforced resin.

According to one embodiment of the invention, a hollow golf club head includes a fiber-reinforced-plastic body and a metal body. The fiber-reinforced-plastic body includes a main portion of a crown portion. The metal body includes a face portion, a front edge portion of the crown portion continuous with the face portion, and a central portion of a sole portion in a toe-heel direction. The front edge portion of the crown portion made of a metal defines a recess portion in an upper surface thereof. A front edge portion of the fiber-reinforce-resin body overlaps and is joined to the front edge portion of the crown portion made of the metal.

According to this structure, the fiber-reinforced-plastic body is superposed on the upper surface of the front edge portion of the crown portion made of the metal, and the recess portion is formed in the front edge portion of the crown portion. For this reason, when the adhesive resin is interposed between the metal crown portion and the prepreg sheet used to form the fiber-reinforced-plastic body, and is subjected to heating and pressurization, the adhesive resin is caught in the recess portion and is prevented from flowing out. Namely, the recess portion functions as an anchor for the adhesive resin.

As a result, the adhesive resin can be reliably interposed between the metal crown portion and the prepreg sheet, thereby making it possible to join the two members.

According to the above-described structure, the recess portion also functions as an anchor portion for enhancing the bonding strength between the fiber-reinforced-plastic body and the front edge portion of the crown portion made of the metal, so that the strength and durability of the golf club head improve.

A bonding resin may be present in the recess portions.

Since the adhesive resin may remains in the recess portion, the adhesive resin serve as a bonding resin for joining the fiber-reinforced-plastic body and the metal crown portion.

The metal body further may include a front edge portion of a side portion continuous with the face portion. The front edge portion of the side portion may define a recess portion in an outer surface thereof. The front edge portion of the fiber-reinforce-resin body may overlap and be joined to the front edge portion of the side portion made of the metal.

Also, the bonding resin may be present in the recess portion of the crown portion and the recess portion of the side portion.

According to this structure, the bonding strength between the metal crown portion and the fiber-reinforced-plastic body becomes high.

Each of the recess portions of the metal crown portion may be a substantially circular recessed hole. The front edge portion of the crown portion made of the metal may define a plurality of recess portions over the entire front edge portion of the crown portion.

A depth of each recessed hole may be in a range of 0.1 to 1 mm.

The upper surface of the front edge portion of the crown portion may be formed into a rough surface.

According to this structure, it is possible to increase the bonding strength between the entire metal crown portion and the fiber-reinforced-plastic body.

A radius of curvature of the front edge portion of the crown portion from a toe side toward a heel side may be in a range of 60 mm to 150 mm.

DETAILED DESCRIPTION OF THE EMBODIMENTS

Figure 1:
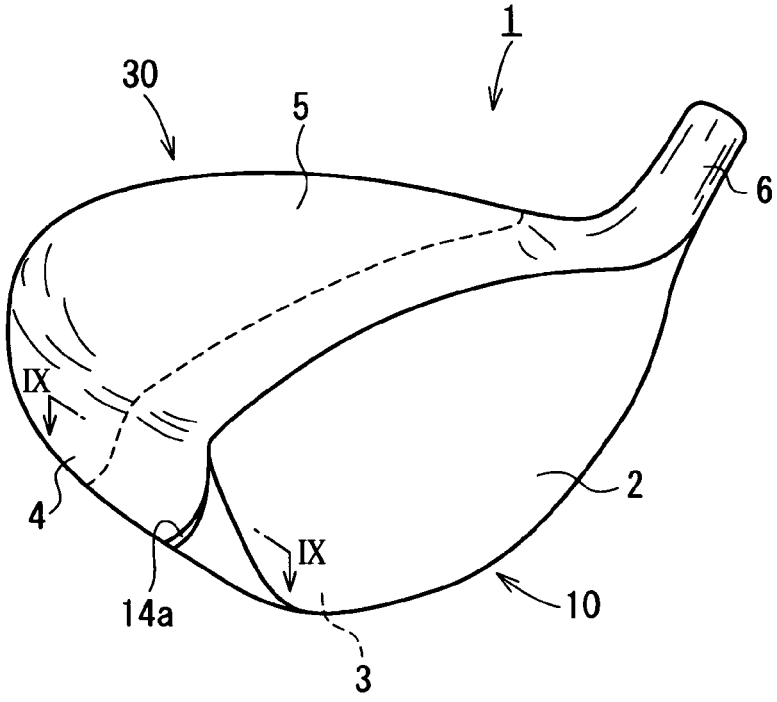
FIG. 1 is a perspective view of a golf club head according to an embodiment of the invention.
Figure 2A:
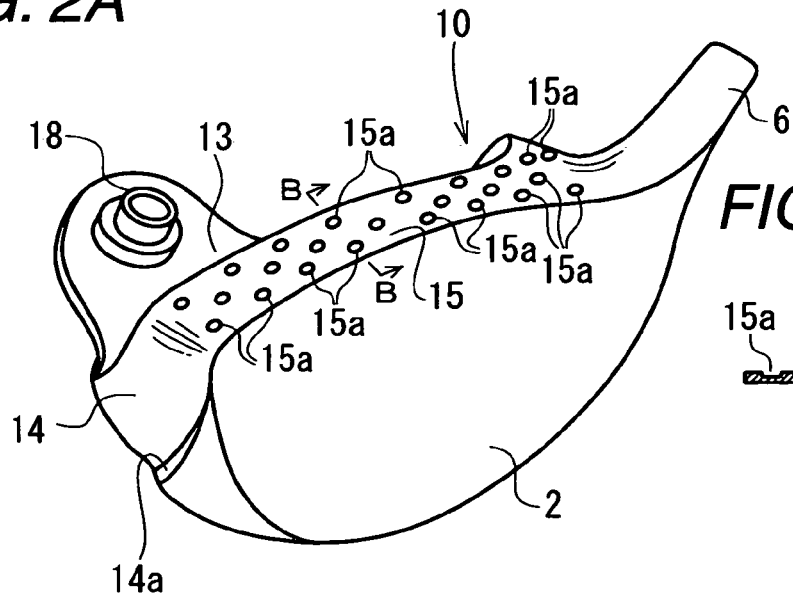
FIGS. 2A and 2B are perspective views of a metal body of the golf club head shown in FIG. 1 as viewed from the front side of the golf club head.
Figure 2B:
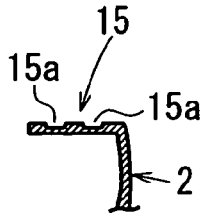
Figure 3:
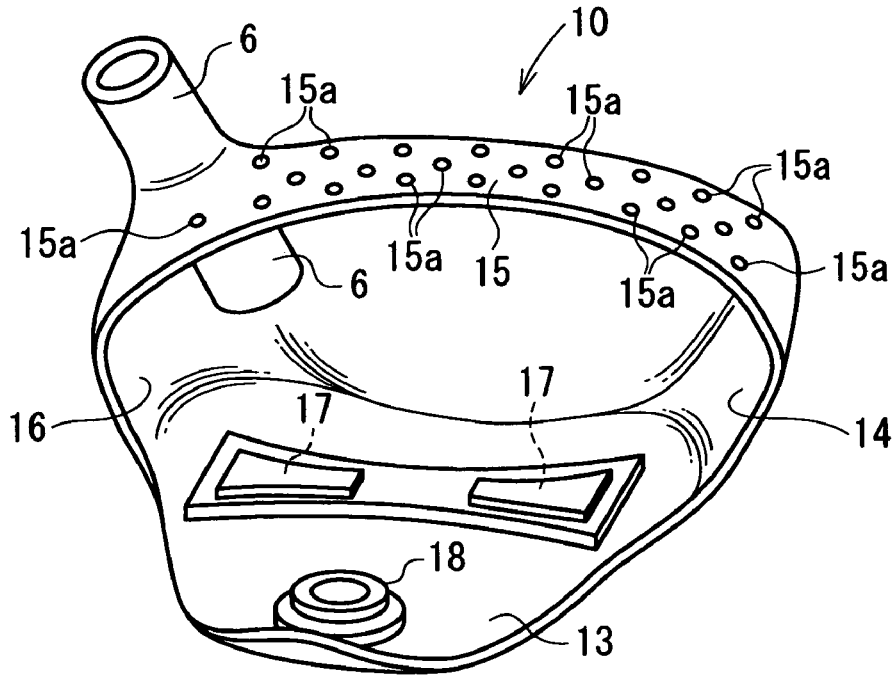
FIG. 3 is a perspective view of the metal body of the golf club head shown in FIG. 1 as viewed from the rear side of the golf club head.
Figure 4:
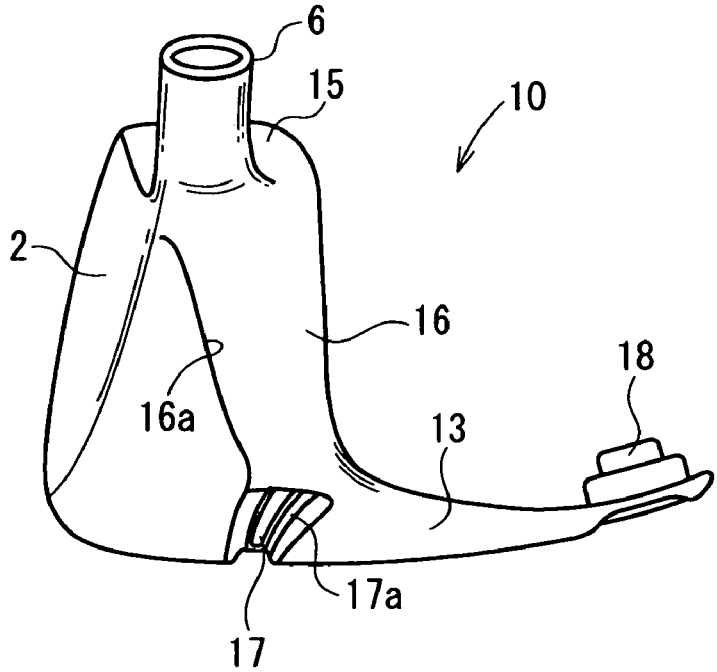
FIG. 4 is a side view of the metal body of the golf club head shown in FIG. 1 as viewed from the heel side of the golf club head.
Figure 5:
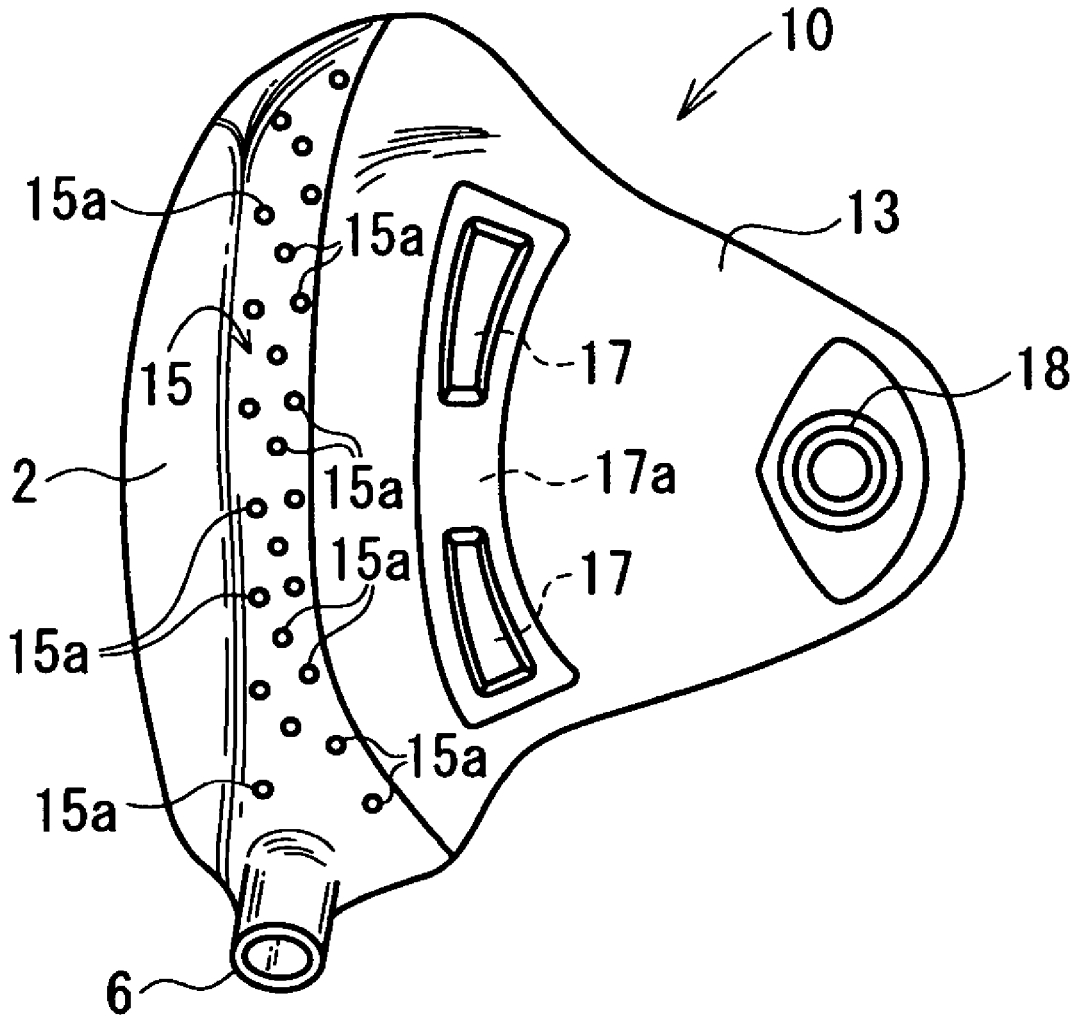
FIG. 5 is a plan view of the metal body of the golf club head shown in FIG. 1.
Figure 6A:
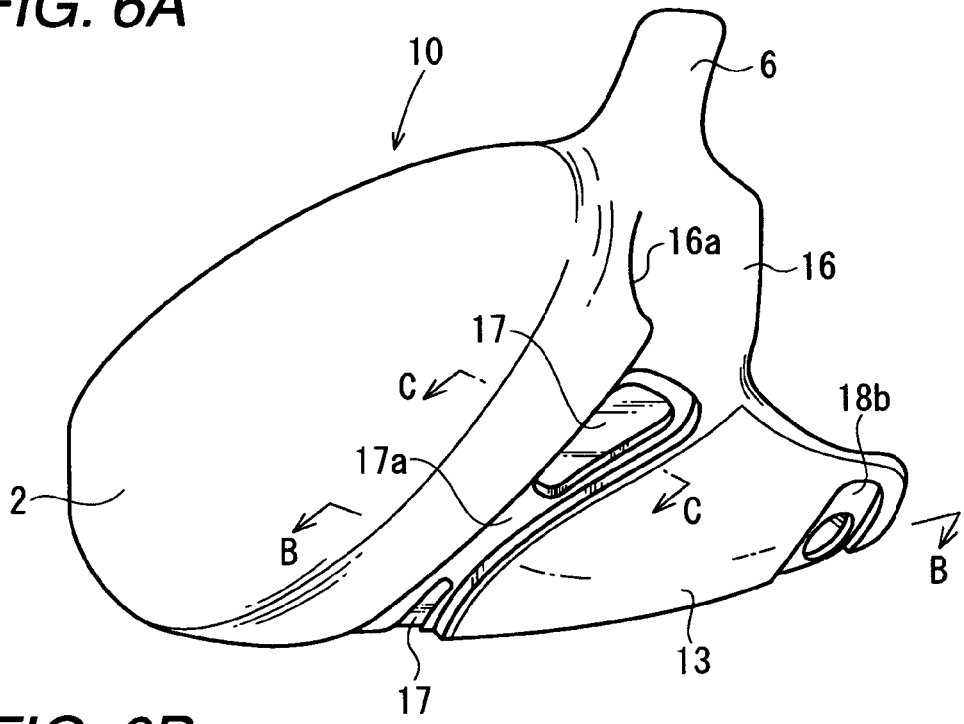
FIG. 6A is a perspective view of the metal body of the golf club head shown in FIG. 1 as viewed from the sole side of-the golf club head.
Figure 6B:
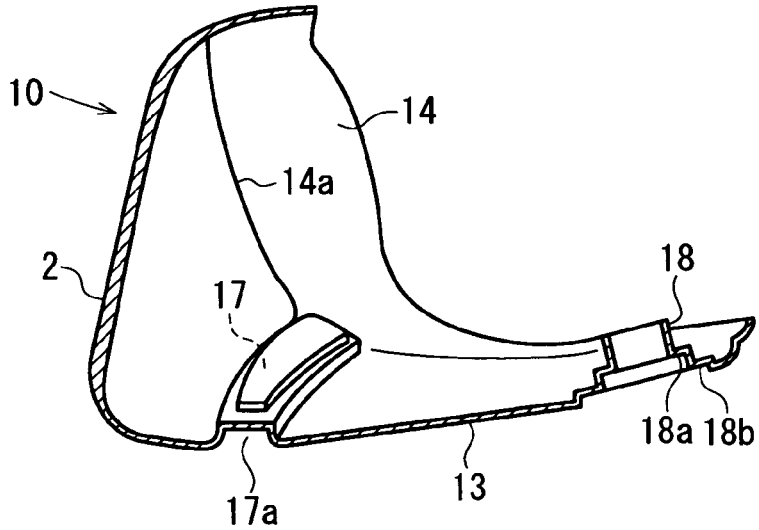
FIGS. 6B and 6C are section views taken along line B-B and line C-C, respectively, in FIG. 6A.
Figure 6C:
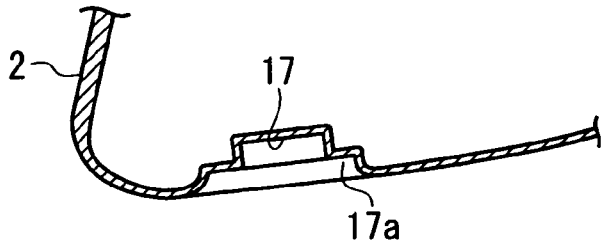

Hereafter, a description will be given of the embodiments of the invention with reference to the drawings.

This golf club head 1 is a hollow wood-type golf club head having a face portion 2, a sole portion 3, a side portion 4, a crown portion 5, and a hosel portion 6.

The face portion 2 is a surface for hitting a ball, and is formed with grooves (score lines), which are not shown. The sole portion 3 constitutes a bottom portion of the golf club head. The side portion 4 constitutes side surface portions on the toe side, the heel side, and the rear surface side. The crown portion 5 constitutes an upper surface portion of the golf club head. A shaft is inserted into the hosel portion 6. The shaft is secured by means of an adhesive agent.

This golf club head 1 includes a metal body 10 and a fiber-plastic-resin body (hereafter referred to as the FRP body) 30.

The metal body 10 has the face portion 2, a metal sole portion 13, a metal side portion (toe) 14, a metal crown portion 15, a metal side portion (heel) 16, recesses 17 respectively formed on the toe side and the heel side of a front portion of the metal sole portion 13, an annular member 18 provided in the rear of the metal sole portion 13, and the hosel portion 6.

The metal crown portion 15, which constitutes a front edge portion of the crown portion 5, is continuous with the metal side portion (toe) 14 and the metal side portion (heel) 16. The metal side portion (toe) 14 and the metal side portion (heel) 16 are respectively continuous with the metal sole portion 13. The metal crown portion 15, the metal side portions 14 and 16, and the metal sole portion 13 are continuous with the face portion 2.

The metal crown portion 15 is smoothly curved from the toe side toward the heel side so as to be upwardly convex. The radius of curvature of this curve is preferably in a range of 60 mm to 150 mm or thereabouts.

A plurality of shallow recessed holes 15*a* serving as recess portions are defined in an upper surface of this metal crown portion 15 over a substantially entire area of the metal crown portion 15. In this embodiment, the recessed hole 15*a* is circular, and its diameter is preferably in a range of 0.1 mm to 2.0 mm, particularly in a range of 0.3 mm to 1.5 mm. Its depth is preferably in a range of 0.1 mm to 1 mm, particularly in a range of 0.1 mm to 0.8 mm, especially in a range of 0.1 mm to 0.5 mm, optimally in a range of 0.1 mm to 0.3 mm. The number of the recessed holes 15*a* is preferably in a range of 5 to 300, particularly in a range of 10 to 200 or thereabouts.

A front portion of the metal sole portion 13 extends over an entire width of the golf club head from the toe side to the heel side. The width of this metal sole portion 13 becomes gradually narrow from the front portion toward the rear portion. The rear portion of the metal sole portion 13 is disposed at a central portion of the golf club head in the heel-toe direction.

Shallow recesses 17 are respectively formed in the front portion of the metal sole portion 13 on the toe side and the heel side. Each recess 17 extends in the toe-heel direction. A shallow groove portion 17*a* extending in the toe-heel direction is formed in a front region of the metal sole portion 13 including these recesses 17. The transverse width of this groove portion 17*a* is large on the toe side and the heel side, and is small in the vicinity of its center in the toe-heel direction. The groove portion 17*a* surrounds the recesses 17.

First weight members 20 are respectively accommodated in the recesses 17. A resin plate 21 formed of a resin molded piece is fitted to the groove portion 17*a* to cover the first weight members 20.

An FRP layer 22 formed of a cured body of a cloth fiber prepreg covers the resin plate 21. The FRP layer 22 is continuous and integral with the FRP body 30, as will be described later.

Figure 7:
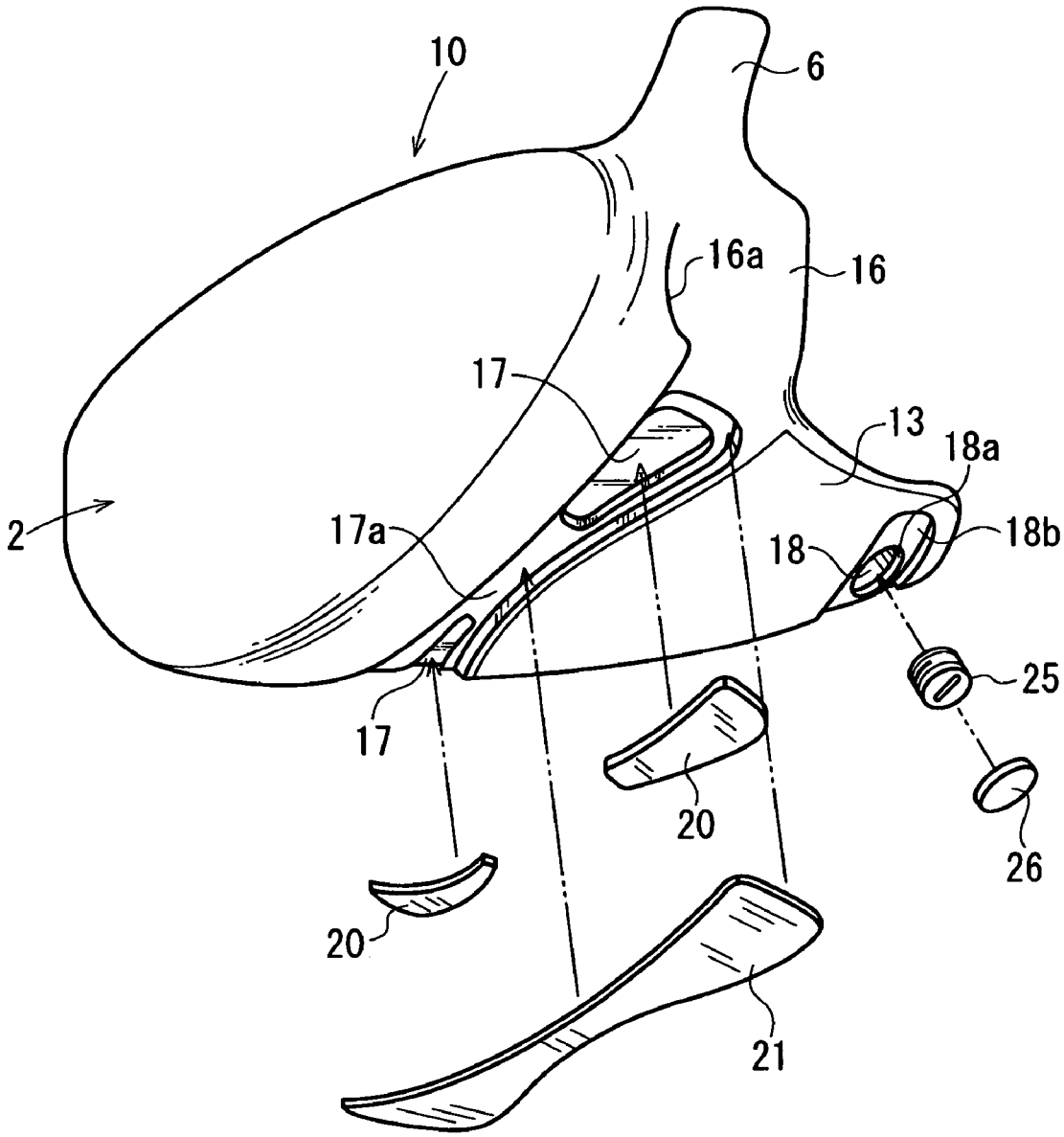
FIG. 7 is an exploded perspective view for explaining an operation of attaching weight members to the metal body.
Figure 8A:
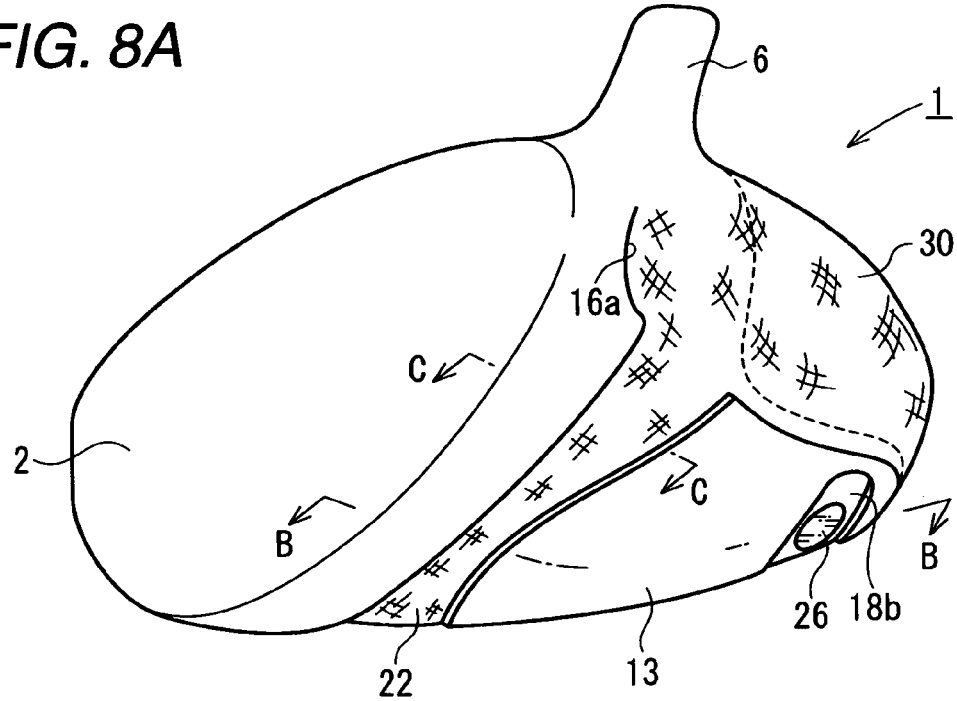
FIG. 8A is a perspective view of the golf club head as viewed from the sole side of the golf club head.
Figure 8B:
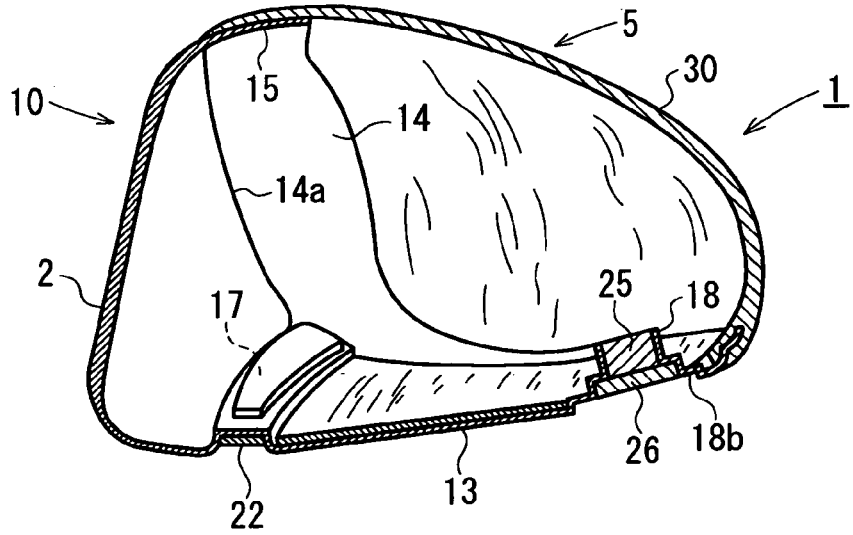
FIGS. 8B and 8C are section views taken along line B-B and line C-C, respectively, in FIG. 8A.
Figure 8C:
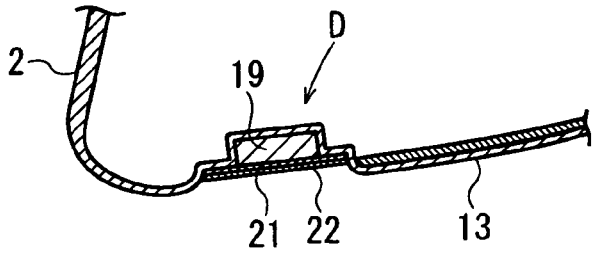
Figure 8D:
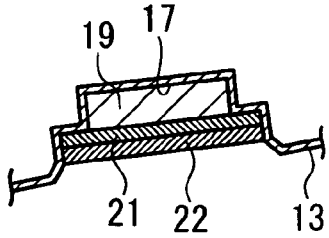
FIG. 8D is an enlarged view of a portion D in FIG. 8C.

The rear portion of the metal sole portion 13 rises up rearward obliquely. The annular portion 18 is integrated with the rear portion of this metal sole portion 13. An internal thread (not shown) is provided on an inner peripheral surface of the annular portion 18, and a screw-like second weight member 25 is screwed thereinto as shown in FIGS. 7 and 8. A first annular recessed portion 18*a* surrounding the annular portion 18 and a second annular recessed portion 18*b* surrounding the first annular recessed portion 18*a* are formed in the metal sole portion 13. A circular plate 26 made of aluminum is fitted and fixed to the first annular recessed portion 18*a* by interference fit.

The face portion 2 is formed of a face plate (not shown) made by forging or press molding. The other portions of the metal body 10 are made by forging. As for this forged piece, an opening is formed in its face portion, and the face plate is fitted into this opening and is secured by caulking, welding, or the like.

The face portion 2 is thick in its center portion and is thin in its peripheral edge portion, thereby to have high repulsion.

The FRP body 30 constitutes the remaining portion of the outer surface of this golf club head 1. Namely, the FRP body 30 has a size for making up substantially the entirety of the crown portion 5, a rear half portion of the side portion 4, and a portion of the sole portion 3 other than the metal sole portion 13.

Figure 9:
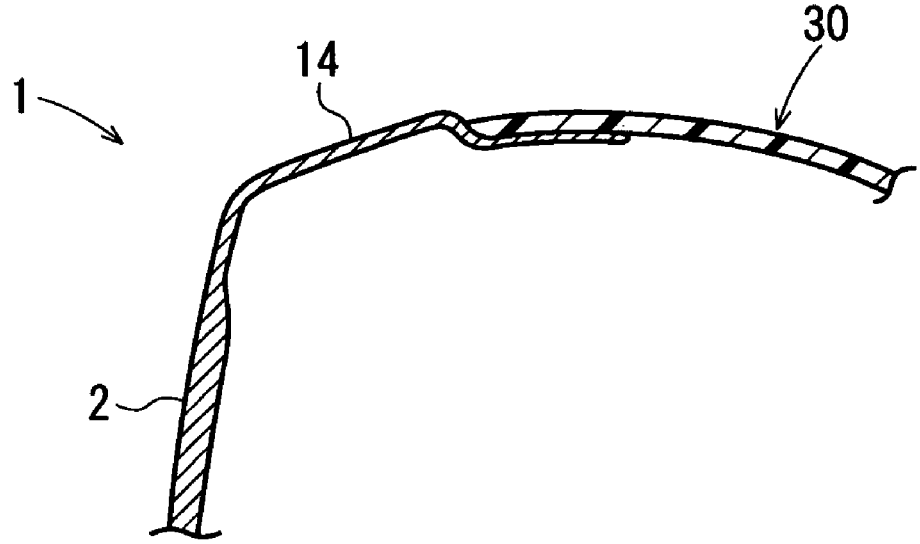
FIG. 9 is a section view taken along line IX-IX in FIG. 1.

As shown in FIGS. 8 and 9 in the enlarged form, the FRP body 30 is closely adhered to outer surfaces of the metal crown portion 15, the metal side portion 14 (both on the toe and heel sides), and the metal sole portion 13.

In the crown portion 5, the FRP body 30 extends to the vicinity of the frontmost edge of the upper surface of the metal crown portion 15. On the heel side and the sole side of the side portion 4, stepped portions 14*a* and 16*a* are formed in the metal body 10. The FRP body 30 extends to the stepped portions 14*a* and 16*a*. The stepped portions 14*a* and 16*a* are steps where the back side is recessed.

To form the FRP body 30 and integrate it with the metal body 10, a mold having an outline shape of the golf club head 1 is prepared, and a first prepreg sheet (an uncured resin-fiber composite sheet) in which fibers are oriented in two orthogonal directions is laid along the inner surface of the mold. This first prepreg sheet is laid on the entire outer surface of the FRP body 30 and at a position for covering the aforementioned groove portion 17*a*.

Next, a plurality of second prepreg sheets in which fibers are oriented in one direction are superposed on the first prepreg sheet. The plurality of second prepreg sheets are laminated such that the directions of the fibers are alternate.

Next, the metal body 10, to which the first weight members 25 and the resin plate 21 have been fitted but the first weight member 20 and the circular plate 26 have not been fitted, is placed in the mold.

At this time, an adhesive resin (e.g., a viscous solution in which an epoxy resin, a vinyl ester resin, or the like is dissolved in an organic solvent) is attached in advance to portions of the metal body 10, onto which the prepreg sheet is superposed, such as the metal crown portion 15. A thermosetting resin, which is cured in 3 to 15 minutes at a temperature of 120 to 150° C. is suitable as the adhesive resin.

Next, a third prepreg sheet is superposed on the inner surface the metal sole portion 13 of the metal body 10 (posterior to the groove portion 17*a*, and excluding the annular portion 18). Subsequently, this assembly is heated in a state where gas pressure is applied to its interior through the opening in the annular portion 18, thereby allowing the resin to cure. At this juncture, a resin bag made of nylon or the like may be placed in advance inside the golf club head 1, and gas may be supplied into this bag to inflate it, thereby allowing the prepreg sheets to be pressed and brought into close contact with the inner surface of the mold.

Consequently, the FRP body 30 is formed, and the peripheral edge portion of the FRP body 30 is brought into close contact with the metal body 10, as shown in FIG. 8. In addition, the resin plate 21 is covered with the FRP layer 22 formed of the cured piece of the first prepreg sheet. After completing the molding, the mold is released, and a vibration absorbing layer and a hitting-sound adjusting layer are formed on the inner surface of the golf club head, if necessary. For example, an adhesive including polyisobutyrene is pasted in a layered state, thereby to prevent rattling sound from occurring in the golf club head 1.

Next, the second weight member 25 is screwed into the annular portion 18, and then the metal plate 26 made of aluminum is fitted and secured into the first annular recessed portion 18*a*. Subsequently, polishing and painting are performed with respect to the outer surface of this golf club head if necessary, thereby to form a golf club head product.

In the above-described heating and pressurizing step, the adhesive resin is attached to the portions of the metal body 10, onto which the prepreg sheet is superposed, such as the metal crown portion 15. Moreover, since the plurality of recessed holes 15*a* are formed in the metal sole portion 15, even if the adhesive resin becomes low in viscosity due to heat, the adhesive resin does not flow out from between the prepreg sheet and the metal crown portion 15. For this reason, it is possible to manufacture the golf club head 1 in which the FRP body 30 is properly joined to the metal crown portion 15. In addition, in this golf club head, since the large number of recessed holes 15*a* also function as anchor portions, which increase the bonding strength between the FRP body 30 and the metal crown portion 15, the strength and durability of the golf club head 1 excel. Resin components derived from the adhesive resin may be present in the recessed holes 15*a*, or may be absorbed by the resin of the prepreg sheets, and resin components derived from the prepreg sheets may be present in the recessed holes 15*a*.

Next, a description will be given of preferred specification of this golf club head 1.

The weight of the FRP body 30 is preferably in a range of 5% to 30%, particularly 10% to 25%, especially 15% to 20%, of the total weight of the golf club head 1.

The total weight of the golf club head 1 is preferably in a range of 175 g to 250 g. If the loft angle of the golf club head 1 is less than 13°, the total weight of the golf club head 1 is preferably in a range of 175 g to 200 g or thereabout. As a constituent material of the metal body 10 other than the weight members, titanium alloy, stainless steel, maraging steel, copper alloy, zirconium alloy, or the like is suitable. In particular, among others, titanium alloy such as Ti-6Al-4V is suitable.

In the case where the face plate is made by forging or press molding, titanium alloy (particularly β type) such as Ti-6Al-4V, Ti-15V-3Cr-3Sn-3Al, and T-22V-4Al is preferable as material of the face plate. It is possible to enhance the strength and hardness of P type titanium alloy by heat treatment after plastic working.

In the case where forging is carried out, investment forging is suitable. In order to ensure that molten metal reaches up to thin-walled portions sufficiently, it is preferable to perform vacuum forging or centrifugal forging.

As the weight members, tungsten or tungsten alloy having the specific gravity of 10 or greater, preferably 12 or greater, is suitable.

In the case where the metal body 10 is made of titanium alloy, not only the above-described materials, but also stainless steel, a copper alloy and lead may be used for the weight members.

The first weight members 20 may be fixed to the recesses 17 by caulking, press fitting, or bonding with a bonding adhesive.

The second weight member 25 may be fixed to the annular member 18 by brazing or welding.

As a prepreg for molding the FRP body 30, it is possible to use any one of a cloth fiber prepreg, a unidirectional fiber prepreg, and the like. In a case where an SMC prepreg is used as this prepreg, it is possible to easily form the thin-walled FRP body 30.

The FRP body 30 is preferably formed by laminating three to eight prepregs or thereabouts.

As fibers in the prepreg, carbon fibers or the like having elastic modulus of $20\times10^3$ to $30\times10^3$ kg/mm$^2$ or thereabouts are preferable, but the invention is not limited thereto.

The elastic modulus in the transverse direction at the crown portion 5 can be made lower than that in the toe-heel direction, by adjusting the orientation of the fibers. For example, the cloth fiber prepregs and the unidirectional fiber prepregs are alternately laminated, and the direction of orientation of the fibers of these unidirectional fiber prepregs is set in the toe-heel direction.

A thermosetting resin such as epoxy may be used as the resin of the FRP body 30. A small amount of thermoplastic resin may be mixed in the thermosetting resin, thereby making it possible to improve the vibration absorbing property.

The thickness of the FRP body 30 is preferably in a range of 1 mm to 3 mm. In particular, the thickness of the crown portion 5 thereof is preferably in a range of 1 mm to 2 mm, especially 1 mm to 1.5 mm, e.g., approximately 1.3 mm or thereabouts.

The invention is suitably applied to a large-size head having a size of 300 $cm^3$ or greater, particularly 350 $cm^3$ or greater, e.g., in a range of 350 $cm^3$ to 400 $cm^3$. There is no upper limit to the size of the head. It is technically possible to manufacture a large-size head of 600 $cm^3$ or thereabouts.

This golf club head 1 is provide with the second weight member 25 so that the depth of the center of gravity is deep and the first weight members 20 are provided. Therefore, the sweet area in the toe-heel direction is large. Further, the degree of freedom in designing a position of the center of gravity is large. Since the first weight members 20 are covered with the FRP cured layer 22, the aesthetic appearance is excellent. The second weight member 25 is also covered with the metal plate 26, so that the aesthetic appearance is also excellent. A resin may be used instead of the metal plate 26.

Figure 10:
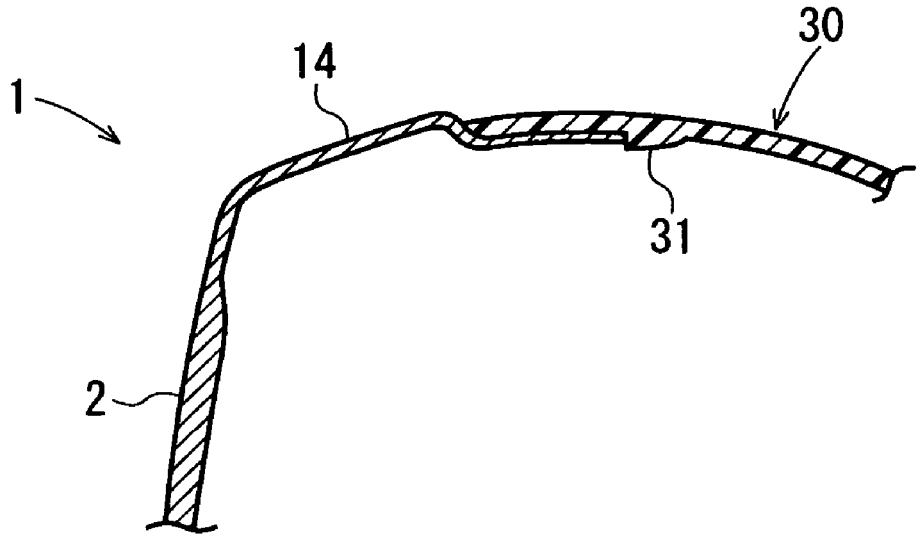
FIG. 10 is a section view illustrating another embodiment.
Figure 11:
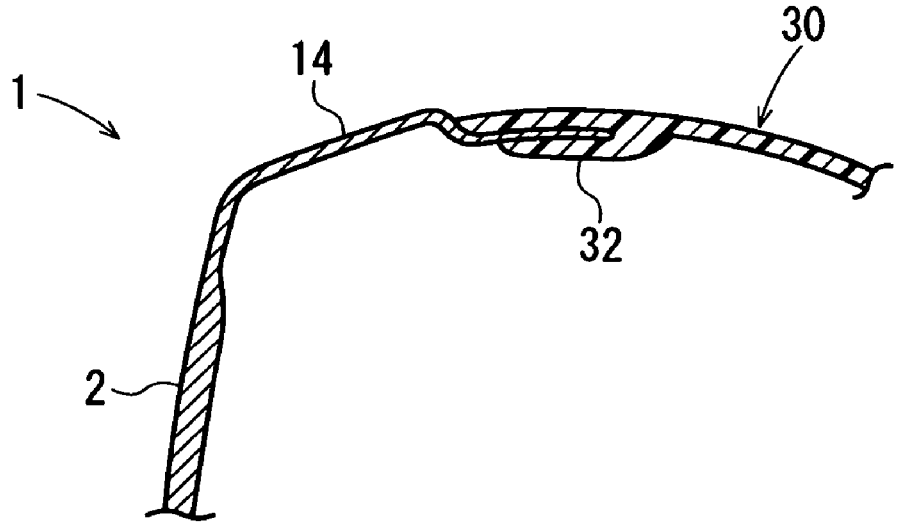
FIG. 11 is a section view illustrating still another embodiment.
Figure 12:
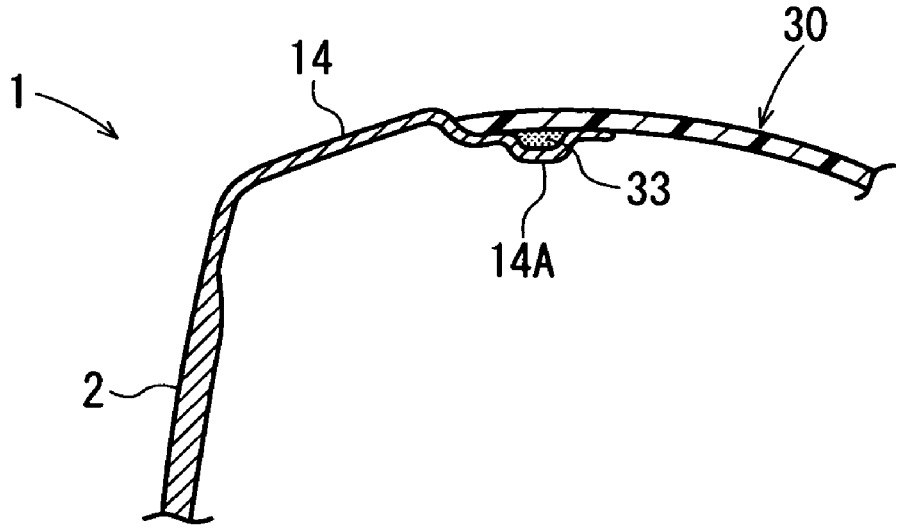
FIG. 12 is a section view illustrating a further another embodiment.

In the invention, it is possible to adopt structures as shown in FIGS. 10, 11, and 12 to enhance the bonding strength between the FRP body 30 and the metal body 10.

In FIG. 10, a protruding portion 31 abutting against an end face of the metal body 10 (in this case, the metal side portion 14) is provided on the inner surface of the FRP body 30.

In FIG. 11, an overlay portion 32 clamping an end of the metal body 10 (in this case, the metal side portion 14) is provided on the inner surface of the FRP body 30.

In FIG. 12, recess 14A is formed in the metal body 10 (in this case, the metal side portion 14). Since a bonding adhesive 33 is filled in this recess 14A, the FRP body 30 and the metal side portion 14 are bonded together.

Although in the above-described embodiments the circular recessed holes 15*a* are formed in the metal crown portion 15, these recessed holes may have elliptical, square, or other similar shapes, or may be elongated grooves. In the present invention, the upper surface of the metal crown portion 15 may be formed into a rough surface by, for example, sandblast treatment or sanding with sand paper.

What is claimed is:

1. A hollow golf club head comprising:

a fiber-reinforced-plastic body including a main portion of a crown portion; and a metal body including a face portion, a front edge portion of the crown portion continuous with the face portion, and a central portion of a sole portion in a toe-heel direction, wherein:

the front edge portion of the crown portion made of a metal defines a recess portion in an upper surface thereof, a front edge portion of the fiber-reinforced-plastic body overlaps and is joined to the front edge portion of the crown portion made of the metal; and the central portion of the sole portion narrows as the sole portion extends from a front to rear direction, wherein a front part of the sole portion comprises a groove portion which extends in a heel-toe direction.

2. The golf club head according to claim 1, wherein the groove portion contains a plurality of recesses which are formed at the heel side and the toe side, respectively.

3. The golf club head according to claim 2, wherein each of the plurality of recesses is narrowest nearest the central portion of the sole portion.

4. The golf club head according to claim 3, wherein weight members are fitted into each of the plurality of recesses.

5. The golf club head according to claim 4, wherein a resin plate is fitted in the groove portion to cover the weight members.

6. The golf club head according to claim 4, wherein the central portion of the sole portion further comprises a threaded annular recess.

7. The golf club head according to claim 6, wherein a screw-like weight member is disposed within the threaded annular recess.

8. The golf club head according to claim 7, wherein a lightweight metal plate covers the threaded annular recess.

* * * * *